United States Patent [19]

Jou

[11] Patent Number: 4,769,579

[45] Date of Patent: Sep. 6, 1988

[54] FLICKER-CONTROL DEVICE WITH POLARIZED LAMP

[76] Inventor: Tom Jou, 4th Fl., No. 9, 16 Lane, Taili Street, Taishan Hsiang, Taipei, Taiwan

[21] Appl. No.: 904,361

[22] Filed: Sep. 8, 1986

[51] Int. Cl.[4] ..... H05B 37/00

[52] U.S. Cl. ..... 315/201; 315/130

[58] Field of Search ..... 315/200 R, 200 A, 201, 315/130, 132

[56] References Cited

U.S. PATENT DOCUMENTS 3,530,501 9/1970 Benschoten ..... 315/201

3,617,766 11/1971 Kahn ..... 315/200 R

FOREIGN PATENT DOCUMENTS 528593 9/1976 U.S.S.R. .

*Primary Examiner*—Leo H. Boudreau

*Assistant Examiner*—Theodore Salindong

*Attorney, Agent, or Firm*—Morton J. Rosenberg

[57] ABSTRACT

This invention utilizes the property of diodes to judge positive/negative voltage, and connecting general incandescent lamps in parallel to combine, as lamp-strings, with each being polarized. The lamp-string is assembled with flicker-control device, a power supply using AC source which offers direct current with positive and negative variation to provide an assembly of a flicker-control device and lamp-strings for advertisement, decoration and other applications and a flickering function.

2 Claims, 5 Drawing Sheets

FLICKER-CONTROL DEVICE WITH POLARIZED LAMP

BACKGROUND OF THE INVENTION

This invention has been invented in view of the following disadvantages of conventional articles. The incandescent lamps in the lamp set used in conventional advertising board, decoration and other applications were in paralled connection and its power supply was AC power source. Thus, the power distributor was a necessity to work out the flickering effect for those incandescent lamps in parallel connection. But the cost is high and engineering is not convenient. Also, there are lamp sets for decoration (such as C-7, C-9) with ability of being fully dark and light (i.e. "flickering") only when the bi-metal switch applied to connect and disconnect the power source was in action. The expected flickering effect (being fully dark and light) of lamp set (C-7/C-9) is not satisfactory because of the faiure of full on/off of the bi-metal switch. Besides, the kind of flickering variety that it offers is only one. With this invention, however, a number of flickering varieties is expected and those defects of convention ways are no longer existing.

SUMMARY OF THE INVENTION

This invention relates to an assembly of flicker-control device and polarized lamps with characteristic of employing the positive and negative voltage in dual-conductor wires to produce the prearranged flickering effects.

Figure 1:
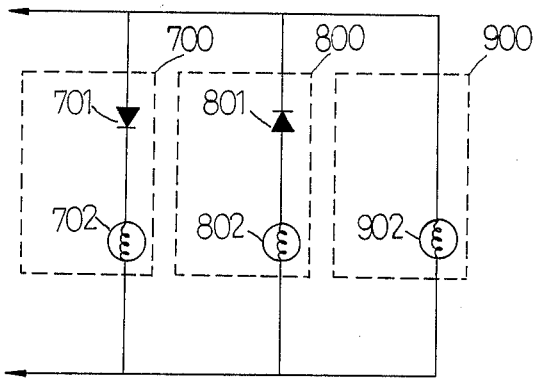
FIG. 1 illustrates the definition of polarized lamps.

Please refer to FIG. 1, the sinusoidal voltage from the power line is applied to the polarized lamps. For the diodes (701, 801) in FIG. 1, the diode (701) allows only the positive half-cycles to appear at the lamp (702). Reversing the diode (801) allows only the negative half-cycle to appear at the lamp (802). Without a diode connected to a lamp such as lamp (902) there will exist a full cycle of the sine-wave.

We define that in such condition:

"700" is a positive-polarity lamp.

"800" is a negative-polarity lamp.

"900" is a non-polarity lamp.

For explanation, we take C-7/C-9 decoration lamp for example.

Figure 2:
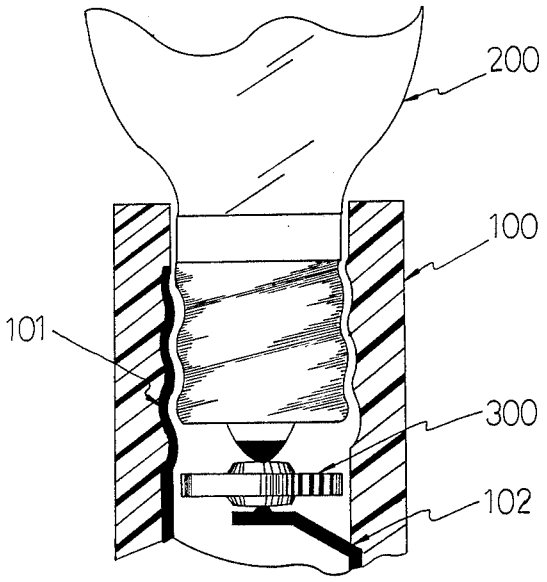
FIG. 2 illustrates the polarized lamp of this invention.

Please refer to FIG. 2, the structure diagram of a polarized lamp of this invention. The lighting set includes a light housing (100) in which a neutral conductor plate (101) and a line conductor plate (102) are mounted.

If the anode of diode in pad is connected with line conductor plate (102), the lamp then has positive-polarity like "700" in FIG. 1.

If the cathode of diode in pad is connected with line conductor plate (102), the lamp then has negative-polarity like "800" in FIG. 1.

If no pad is mounted to line conductor plate (102), the lamp then has no polarity like "900" in FIG. 1.

Figure 3:
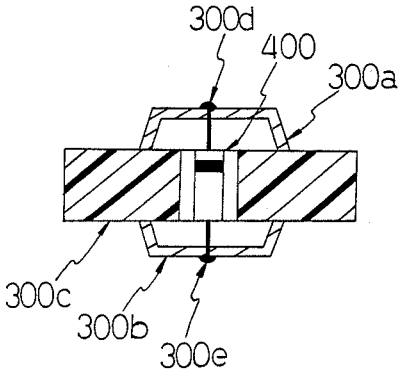
FIG. 3 illustrates the structure of pad of this invention.

Please refer again to FIG. 3, the structure diagram of pad. FIG. 3 illustrates a hollow fire-resistant plastic plate (300*c*), a diode (400), and two conductor plates (300*a*, 300*b*). In this assembly, conductor plates are molded with each pin of diode (400) individually. Two beads (300*d*, 300*e*) are also shown in this figure.

Figure 4:
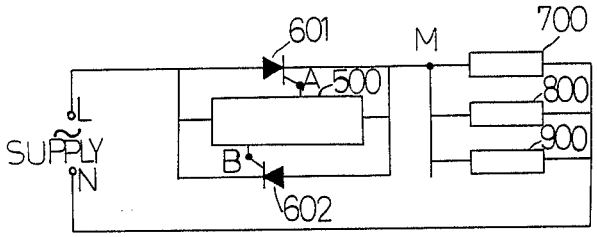
FIG. 4 illustrates the block diagram of this invention.

As illustrated in FIG. 4, the block diagram of this device includes two silicone controlled rectifiers (SCR) (601,602), an oscillator-trigger circuit (500), positive-polarity lamps (700), negative-polarity lamps (800), and non-polarity lamps (900). When a power source is connected, two output signals at point A and B of the oscillator-trigger circuit (500) are at a stable state; so that at any time there will be only one silicone controlled rectifier working. Therefore, the common output point M of two SCRs (601, 602) has either a positive or negative voltage. The positive-polarity lamps (700) are only activated only when M-point is positive voltage, while the negative-polarity lamps (800) are activated only when M-point is negative voltage. Therefore, when the positive-polarity lamps (700) or negative-polarity lamps (800) flicker, the non-polarity lamps (900) are kept on during the time of voltage variation.

Figure 5:
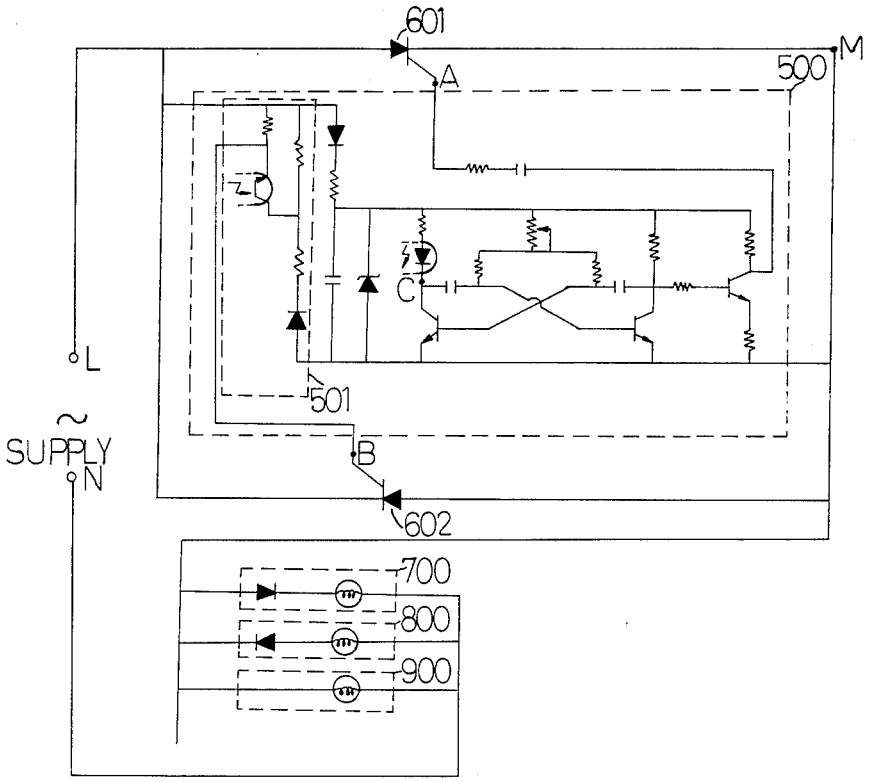
FIG. 5 illustrates the circuit of this invention.

Please refer to FIG. 5 which illustrates the circuit of this invention. When the power source is connected, the oscillator-trigger circuit (500) starts to work immediately with the output points A and B as explained in the following:

1. When "A" point is a high voltage and "B" point is a low voltage, SCR (601) is turned on by applying a high voltage from "A" point to the gate terminal of SCR (601). Therefore, SCR (602) is turned off by applying a low voltage from "B" point to the gate terminal of SCR (602). Therefore, a positive voltage is produced at "M" point, the positive-polarity lamps (700) will light, but the negative-polarity lamps (800) will not light no matter what polarity the voltage of "M" point has.

2. When "A" point is a low voltage and "B" point is high voltage, SCR (601) is turned off by applying a low voltage from "A" point to the gate terminal of SCR (601). Thereafter, SCR (602) is turned on by applying a high v voltage from "B" point to the gate terminal of SCR (602). Therefore, a negative voltage is produced at "M" point, the positive-polarity lamps (700) will not light, but the negative-polarity lamps (800) will light. Non-polarity lamps (900) light regardless of the polarity of point "M".

3. With two SCRs in the inverse-parallel connection shown in FIG. 5, the triggerig potential of the SCRs is different with regard to the common-ground in the circuit system of FIG. 5. Isolation (using photo-coupler) and triggering function of circuit (501) make the transfer of trigger signal at "C" point to the gate of SCR (602) possible.

4. Oscillatory frequency of circuit (500) is designed to be below 3 Hz. With this frequency, therefore, the flicker effect and its variety produced in the way mentioned in (1) and (2) above, can be seen with human eye.

To conclude, the above construction and operation, this invention has the following advantages:

1. Cost reduction: Conventional advertising lighting needs a large amount of electric wires, while this invention needs only two conductive wires.

2. Able to change the flickering variation: This invention is designed to be manipulated for the requirement of variation. The user can arbitrarily arrange different polarity combination of those incandescent lamps to give different flickering variation.

3. Saving of electric energy: Polarity-lamps use half-wave direct current, the consumed electric energy is lower than conventional lamps using alternating current.

4. Suitable for mass production: Mass production of this invention can be done by employing the inner pad (refer to FIG. 3) in connection with ordinary incandescent lamps (refer to FIG. 2) It is easy to assemble pad and lamp in productive way.

5. Safety: This flicker-control device possesses neutral point grounded with AC main, and is thus consistent with electrical engineering safety requirement. There are no similar products or products apply the same principle. And this invention is of highly commercial value.

I claim:

1. A polarity lamp assembly comprising:

supply means for receiving an AC power supply voltage;

positive polarity lamp means, having a first input connected to said supply means and a second input, for producing light during positive cycles of the AC power supply voltage;

negative polarity lamp means, having a first input connected to said supply means and a second input, for producing light;

non-polarized lamp means, having a first input connected to said supply means and a second input, for producing light during positive and negative cycles of the AC power supply voltage;

a first SCR having an anode connected to said supply means, a cathode connected to each of said second inputs, and a control input;

a second SCR having an anode connected to said cathode of said first SCR, a cathode connected to said supply means and a control input;

oscillator trigger means, operatively connected between said control inputs of said first and second SCRs and to each of said second inputs, for alternately applying a control voltage to said control inputs so as to alternately light said positive and negative polarity lamp means, said oscillator trigger means comprising a multivibrator; and, trigger means, operatively connected to said oscillator trigger means for providing a trigger signal to control the operation of said oscillator trigger means, said multivibrator including optoisolator means for receiving said trigger signal.

2. A polarity lamp assembly according to claim 1, wherein said multivibrator operates at less than 3 Hz.

* * * * *